US005224447A

United States Patent [19]

Braatz et al.

[11] Patent Number: 5,224,447

[45] Date of Patent: Jul. 6, 1993

[54] AIR GUIDE HOUSING FOR A FAN IMPELLER OF AN INTERNAL COMBUSTION ENGINE

[75] Inventors: Andreas Braatz, Rutesheim; Martin Konermann, Stuttgart, both of Fed. Rep. of Germany

[73] Assignee: Mercedes-Benz AG, Fed. Rep. of Germany

[21] Appl. No.: 974,736

[22] Filed: Nov. 13, 1992

[30] Foreign Application Priority Data

Nov. 15, 1991 [DE] Fed. Rep. of Germany ..... 4137703

[51] Int. Cl.[5] ..... F01P 7/10

[52] U.S. Cl. ..... 123/41.47; 415/173.7; 416/169 A

[58] Field of Search ..... 123/41.49; 415/173.7; 416/169 A

[56] References Cited

FOREIGN PATENT DOCUMENTS

| | | |
|---|---|---|
| 177723 | 8/1985 | European Pat. Off. . |
| 185948 | 11/1985 | European Pat. Off. . |
| 2362014 | 6/1975 | Fed. Rep. of Germany . |
| 2505563 | 6/1976 | Fed. Rep. of Germany . |
| 2740918 | 3/1979 | Fed. Rep. of Germany . |
| 3722105 | 1/1988 | Fed. Rep. of Germany . |
| 3839009 | 5/1990 | Fed. Rep. of Germany . |
| 503113 | 3/1939 | United Kingdom . |
| 991344 | 5/1965 | United Kingdom . |
| 1149040 | 4/1969 | United Kingdom . |
| 1408120 | 10/1975 | United Kingdom . |
| 1471502 | 4/1977 | United Kingdom . |

*Primary Examiner*—Noah P. Kamen

*Attorney, Agent, or Firm*—Evenson, McKeown, Edwards & Lenahan

[57] ABSTRACT

An air guide housing, for a fan impeller of a radiator of internal combustion engines, includes a cowl ring arranged downstream on the radiator and having at least one radial outflow opening. The fan impeller is overlapped at least partially, in the axial direction, by the cowl ring. In order to achieve an improvement in the guiding away of the air and thereby reduce pressure losses in the outflow from the fan, even in the case of restricted installation spaces, guide vanes are provided in the region of the outflow openings.

2 Claims, 2 Drawing Sheets

AIR GUIDE HOUSING FOR A FAN IMPELLER OF AN INTERNAL COMBUSTION ENGINE

BACKGROUND AND SUMMARY OF THE INVENTION

The invention relates to an air guide housing for a fan impeller of a radiator of internal combustion engines. The air guide housing includes a cowl ring which is arranged downstream on the radiator and at least partially overlaps the fan impeller in the axial direction, and a flat baffle wall, which at least partially covers an end wall of the internal combustion engine. The flat baffle wall is arranged downstream, parallel to the plane of running of the fan impeller.

An air guide housing of the generic design is known from German Patent Document 2,505,563. This reference discloses a cowl ring which is designed as an air guide housing. The cowl ring axially surrounds a fan impeller of an engine fan, downstream of which, parallel to the plane of running of the fan impeller, a baffle wall is arranged. Due to the combination of the baffle wall arrangement with a trumpet-shaped design on the outflow-side end of the cowl ring, the air sucked in by the fan impeller is guided away radially in order to thereby reduce pressure losses caused by axial components in the outflow from the fan.

The object on which the invention is based is to further develop an air guide housing of the generic type in such a manner that an improvement in the guiding away of the air is achieved. A preferred channelling direction for the outflow from the fan should be formed, with the result that pressure losses in the outflow, particularly those which occur in restricted installation spaces, will be reduced.

The object is achieved according to the invention by providing at least one radial outflow opening. The one radial outflow opening, in the region of which guide vanes pointing towards the base of the vehicle and having an entry angle corresponding to the exit angle of the outflow from the fan, is arranged on the bottom region of the circumference of the cowl ring. The fan impeller is overlapped to a decreasing extent by the cowl ring from the top to the bottom region of the circumference.

Overall, a channelled preferential direction downwards is imparted to the swirling outflow from the fan and this leads to a reduction of the pressure losses in the outflow precisely in the case of restricted installation spaces with small outflow cross-sections. As a result of this, the guiding of the air out of the engine compartment is improved and, by virtue of the rapid, directed guiding away, the air flow through the radiator is increased and hence the cooling capacity improved. The design of the guide vanes furthermore guarantees impact-free guidance of the flow in the radial direction.

In a further embodiment of the invention, the guide vanes extend axially beyond the fan impeller. As a result, the guide vanes also catch the swirl which forms downstream of the fan, allowing the outflow from the fan to be guided away in the radial direction to an increased extent.

Other objects, advantages and novel features of the present invention will become apparent from the following detailed description of the invention when considered in conjunction with the accompanying drawings.

DETAILED DESCRIPTION OF THE DRAWINGS

Figure 1:
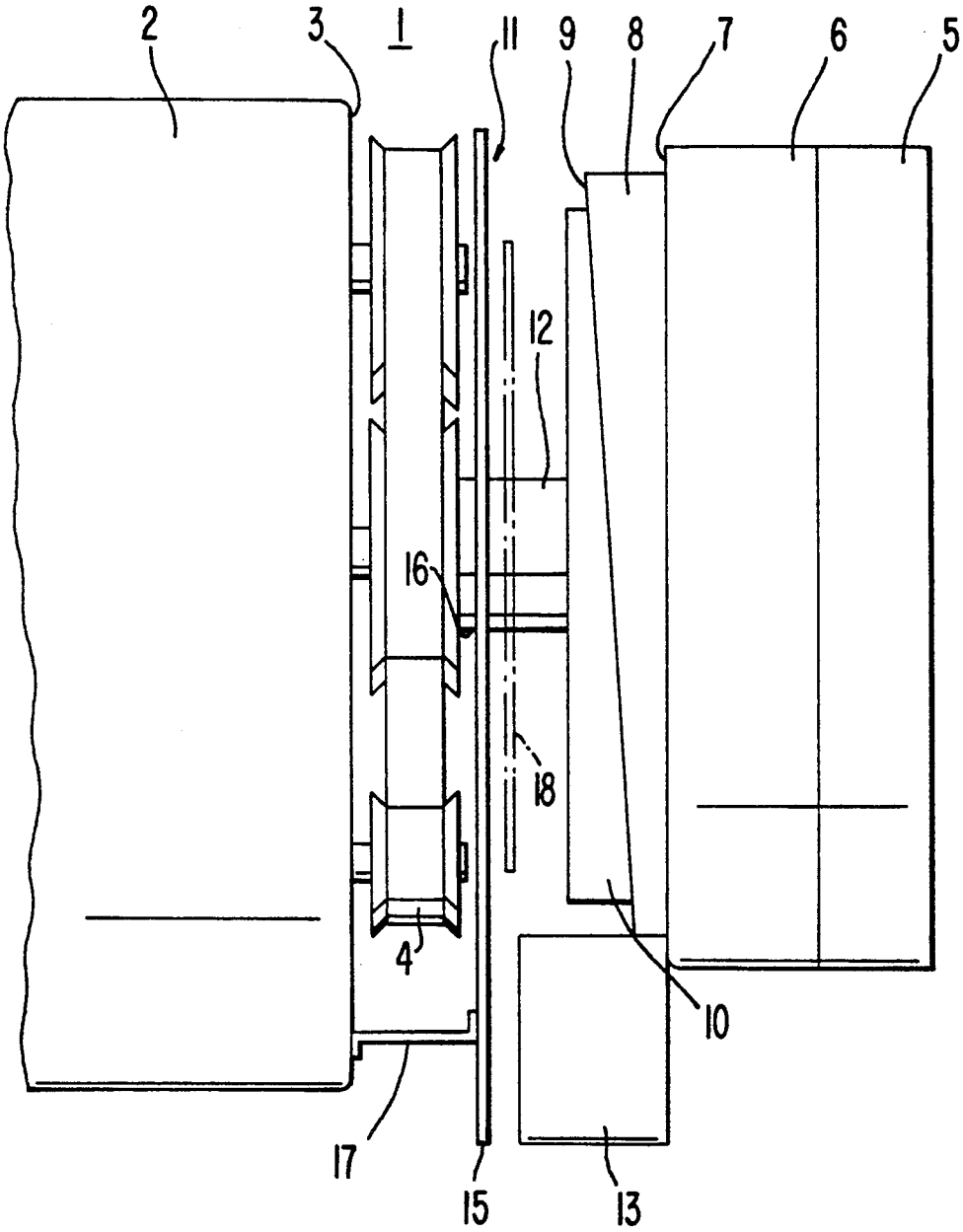
FIG. 1 shows part of an engine compartment in a side view.

FIG. 1 shows part of an engine compartment 1 of a vehicle, in which an internal combustion engine 2 is arranged. The engine 2 has a belt drive 4 mounted on its end face 3. The engine 2 is cooled by a radiator 5, which is connected on the outflow side to an air guide housing. The air guide housing comprises a fan cowl 6, on which a cowl ring 8 of predominantly circular cross-section is formed on the engine-facing side 7. On the outflow side, the cowl ring 8 has a bevelled cowl ring edge 9 which slopes upwards towards the engine 2 as shown in FIG. 1. The cowl ring 8 surrounds a fan impeller 10 of an engine fan and, due to the bevelling of the cowl ring edge 9, the fan impeller is overlapped to a decreasing extent from the top to the bottom region of the circumference. This makes it possible for the outflow from the fan to flow off freely in the radial direction towards the base (not shown in detail) of the vehicle.

Arranged between the fan impeller 10 and the engine 2 is a baffle wall 11. The baffle wall 11 is aligned parallel to the operating plane of the fan impeller 10 and to a large extent covers the end face 3 of the engine 2 which faces the fan impeller 10.

The fan impeller 10 is driven via the belt drive 4 via a drive shaft 12 mounted on the end face 3 of the engine 2. Arranged on the side 7 of the fan cowl 6 which faces the engine are guide vanes 13 for guiding away the outflow from the fan in the radial direction. These vanes are integrally formed on the lower circumferential region of the cowl ring 8 or fan cowl 6. Only the central vane in the lower circumferential region is depicted in FIG. 1 as a representative example.

Figure 2:
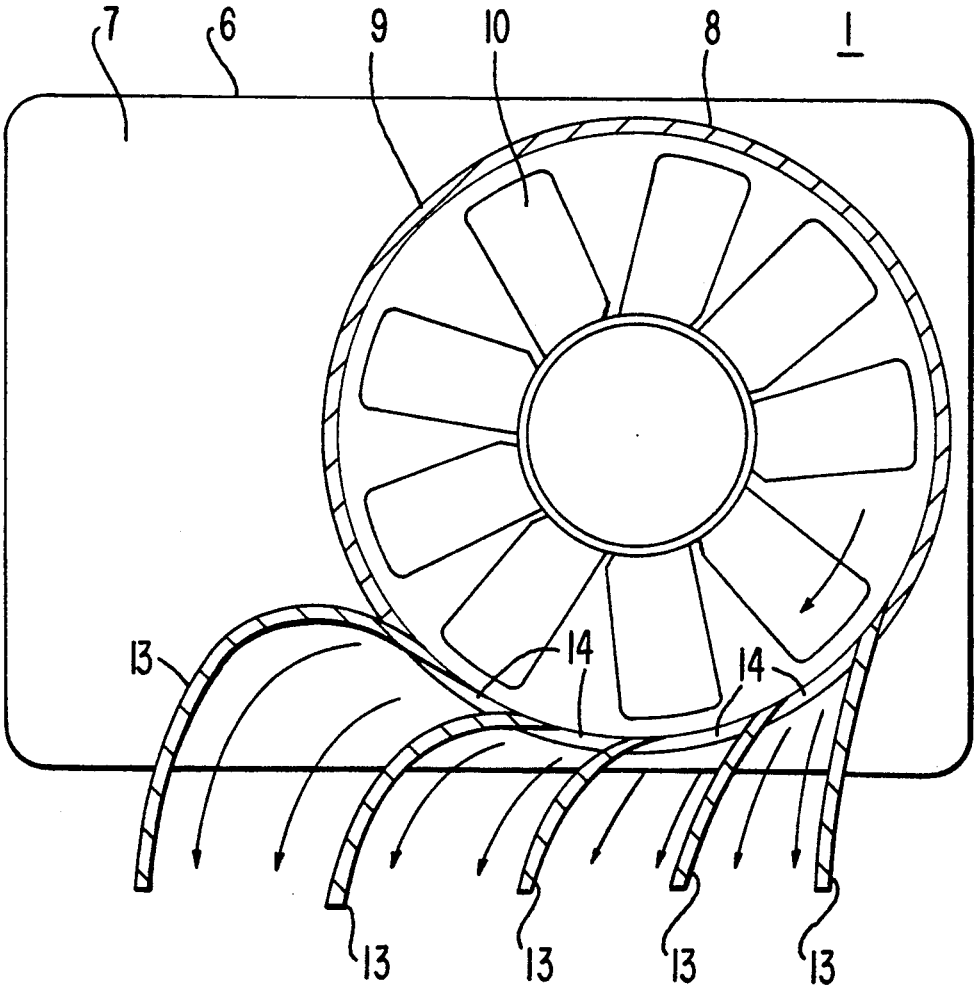
FIG. 2 shows the engine compartment from FIG. 1 in cross-section with a fan impeller and a fan cowl having guide vanes.

As FIG. 2 clearly illustrates, the guide vanes 13 are arched towards the base of the vehicle in the direction of rotation of the fan impeller 10. This gives a high radial outflow capacity. Further, better utilization of the angular momentum of the air sucked in by the fan for guiding away the outflow from the fan is hereby achieved. The exit angle of the outflow from the fan here corresponds at critical cooling-capacity operating points to the entry angle of the guide vanes. The guide vanes 13 extend axially almost as far as the baffle wall 11 and hence completely overlap in the axial direction the fan impeller 10 and outflow openings 14 arranged on the cowl ring 8.

Two alternative ways of arranging the baffle wall 11 are presented in FIG. 1.

On the one hand, the baffle wall 11 can be designed as a flat, fixed baffle plate 15 with a penetration 16 for the drive shaft 12 of the engine fan. The baffle plate 15 is fixed to the engine via a mount 17 in order to avoid movements relative to the fan impeller 10 and engine 2. The arrangement of the baffle plate 15 on the one hand avoids direct impingement on the engine 2 and pressure losses caused, for example, by an uneven end face 3 of the engine 2 are thereby largely avoided. On the other hand, the radial portion of the outflow from the fan is increased, reinforcing the outflow via the guide vanes 13.

In another embodiment to the fixed baffle plate 15, a baffle disc 18 (depicted in chain lines) which rotates with the fan impeller is secured on the drive shaft 12 of the fan impeller 10. Due to the rotary motion of the baffle disc 18, the swirling outflow from the fan has an additional angular momentum imparted to it, the radial outflow thereby being increased even further. In this example, the baffle disc 18 has a smaller diameter than the fan impeller 11, allowing axial components still present in the outflow from the fan to flow past the baffle disc to cool the belt drive 4.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An air guide housing for a fan impeller of a radiator in an internal combustion engine of a vehicle having a base, comprising:

a cowl ring arranged on the radiator facing the engine and at least partially overlapping the fan impeller in an axial direction;

a flat baffle wall arranged parallel to an operating plane of the fan impeller, the flat baffle wall at least partially covering an end wall of the engine facing the fan impeller;

at least one radial outflow opening arranged on a bottom region of the cowl ring's circumference;

guide vanes, in the region of the at least one radial outflow opening, directed toward the base of the vehicle and having an entry angle corresponding to an outflow exit angle from the fan impeller; and wherein the fan impeller is overlapped to a decreasing extent by the cowl ring from the top region to the bottom region of the cowl ring.

2. An air guide housing according to claim 2, wherein the guide vanes extend axially beyond the fan impeller toward the engine.

* * * * *